United States Patent [19]

Svoboda et al.

[11] 4,352,506

[45] Oct. 5, 1982

[54] SKI BRAKE

[75] Inventors: Josef Svoboda, Schwechat; Friedrich Leichtfried, Traiskirchen, both of Austria

[73] Assignee: TMC Corporation, Baar, Switzerland

[21] Appl. No.: 153,243

[22] Filed: May 27, 1980

[30] Foreign Application Priority Data

Jul. 9, 1979 [AT] Austria ..... 4784/79

[51] Int. Cl.[3] ..... A63C 7/10

[52] U.S. Cl. ..... 280/605

[58] Field of Search ..... 280/605, 604

[56] References Cited

U.S. PATENT DOCUMENTS 3,715,126 2/1973 Schwarz ..... 280/605

4,266,802 5/1981 Svoboda ..... 280/605

FOREIGN PATENT DOCUMENTS 2707839 8/1978 Fed. Rep. of Germany ..... 280/605

*Primary Examiner*—Joseph F. Peters, Jr.

*Assistant Examiner*—Milton L. Smith

*Attorney, Agent, or Firm*—Blanchard, Flynn, Thiel, Boutell & Tanis

[57] ABSTRACT

A ski brake having at least one braking leg, which is pivotal by a force applied by a ski boot or by a sole plate to a pedal about an axle, which extends substantially at a right angle with respect to the longitudinal axis of the ski in a mounting member which is secured to the ski, from a braking position against a spring force into a retracted position. The braking leg is pivotal about a swivel shaft which extends in longitudinal direction of the ski when the ski brake is in the retracted position. The braking leg has a sliding segment thereon which slidingly engages during the swing of the ski brake from the retracted position into the braking position a ski binding part to thereby positively effect a driving of the braking mandrel about the axis of the swivel shaft laterally outwardly beyond the lateral edges of the ski.

11 Claims, 15 Drawing Figures

SKI BRAKE

CROSS-REFERENCE TO RELATED APPLICATIONS

This application is related to the subject matter of Ser. No. 6,389, filed Jan. 25, 1979, now U.S. Pat. No. 4,268,060 issued May 19, 1981, and Ser. No. 105,069, filed Dec. 19, 1979.

FIELD OF THE INVENTION

This invention relates to a ski brake and, more particularly, to a ski brake wherein the braking legs are rotatable about axes extending coextensively with and along the side edges of the structure forming the ski boot or sole plate engaging pedal.

BACKGROUND OF THE INVENTION

The ski brake which is described in U.S. Pat. No. 4,268,060, has, compared with conventional ski brakes, great advantages with respect to the simple and effective pivoting of the individual braking mandrels from the braking position into the fully retracted position and vice versa. It, however, requires, aside from the spring (erecting spring) which is needed for pivoting the entire braking mechanism to the braking position, additional springs which bias the individual braking mandrels. The arrangement of such separate springs is, due to the lack of space which in ski brakes exists particularly in the elevational direction, not only problematic, at times not even possible. However, for a satisfactory functioning, the existence of additional operating springs is preferable for the satisfactory operation of the braking mandrels. Tests have shown that under certain snow conditions, in particular in the case of powdery snow, the amounts of snow which accumulate on the sides of the ski can act against an exact pivoting of the individual braking mandrels so that the braking effect fully starts only after an undesired delay.

The object of the invention is to provide a ski brake which is similar to that described in U.S. Pat. No. 4,268,060, and in application Ser. No. 105,069, filed Dec. 19, 1979, but utilizable to its full extent in all snow conditions.

The objects and purposes of the invention have been met by securing a collar on the individual braking legs, namely, in the region where the one wire segment which extends in the longitudinal direction of the pedal transfers over into the other wire segment which extends also in the longitudinal direction of the ski, which collar slidingly engages with its outer surface areas a ski binding part during the swing or pivoting of the ski brake from the fully retracted position into the braking position.

The inventive measure produces a kind of a rigid control, which transmits the force of the existing erecting spring of the ski brake also onto the two braking legs of said ski brake, which spring force is fully sufficient to permit the braking action to also be effective against large masses of snow.

Swiss Pat. No. 229 624 discloses a climbing mechanism, which can be swung by the force of a spring from a locked position (retracted position) into an effective position (climbing position), wherein the existing climbing plates, acting through a stop, roll along individually during the swinging of the climbing mechanism from the effective position on the running surface of the ski into the retracted position on the two side surfaces of the ski to move the two plates into a position which lies parallel to the two side surfaces of the ski. The two plates, however, are in the effective position turned out exclusively by the resistance of the snow, which method of operation, as was above described, cannot be realized in the case of the subject matter of the invention. Rather the necessity exists to act against the resistance of the masses of snow.

Austrian Pat. No. 305 844 (corresponding to U.S. Pat. No. 3,715,126) describes a ski brake, in which the two braking legs lie in the retracted position of the ski brake above the upper surface of the ski and between the two side surfaces of the ski. Guide shoes are provided on the base plate of said ski brake for rotating the individual braking legs, which guide shoes are sloped outwardly and bring about, cooperating with also sloped inner surfaces of the individual braking legs, the start of the already mentioned swinging or rotating movement. However, in this conventional construction, it is necessary to use either a base plate which is as long as the length of the two braking legs, which circumstance as is known can have disadvantageous consequences because of the necessary bending of the ski and furthermore requires a number of fastening screws, which number is higher compared with short base plates. If the mentioned guide shoes are secured separately to the upper surface of the ski, then additional screws are used which bring about a further weakening of the ski member.

Compared with this and in the case of the inventive solution, a separate structural part to increase the capability of swing of the individual braking legs is not necessary, rather the entire ski brake can be mounted in a direct vicinity of a ski binding, so that, as was inventively suggested, a rigid control can take place through an existing ski binding part.

A particularly preferable embodiment of the invention is seen in the ski binding part, along which a collar on each braking leg rolls, being formed by the base plate which is movable on the guide rail of the ski binding in the longitudinal direction of the ski and/or by a holding plate of the ski brake, which holding plate is connected preferably releasably with the base plate. This measure facilitates a dimensioning of the collar of the individual braking legs to the ski binding associated with the ski brake.

A further embodiment of the invention consists in the collar being constructed out of the material of the individual braking legs itself in the form of a bent segment. In this manner, a separately manufactured collar is not needed, which collar is to be mounted on the individual braking mandrels and is secured to same.

In spite of this, it may be preferable if the collar inventively consists of a material which can be worked easier compared with the material of the braking leg, for example of a plastic material. In this case, it is possible to adjust a factory-new ski brake during installation to differently designed ski binding parts or their base plates.

A still further embodiment of the invention consists of providing in the region of the wire segment of the individual braking legs located adjacent the ski binding part, which region serves as a rolling surface, a camlike curvature which rests on said rolling surface. This design is preferable if the ski brake, produced in a factory with a certain ski binding part, is used.

The invention relates furthermore to a ski brake of the above-mentioned type which is characterized by the erecting spring being supported with its two free ends in the support plate, wherein the swivel axis of the pivotal braking mechanism of the ski brake is formed by the two bent free ends of the erecting spring. This measure permits an omission of the use of separate bearing points for the pivot axis of the ski brake, so that the number of the structural parts which are exposed to wear can be reduced. Furthermore, this embodiment has the advantage that the structural height of the entire ski brake can be reduced.

Further inventive characteristics of this development result from the now following description and the associated drawings.

Both here and also in the following detailed description of the invention, the collective term "braking mechanism" is to mean those structural parts of the ski brake which effectively change their position during the performance of the braking process.

BRIEF DESCRIPTION OF THE DRAWINGS

The invention will be described in greater detail hereinbelow with reference to several exemplary embodiments illustrated in the drawings, which reference is not intended to be limiting. Also further details and characteristics will be apparent from these examples.

In the drawings.

DETAILED DESCRIPTION

Figure 1:
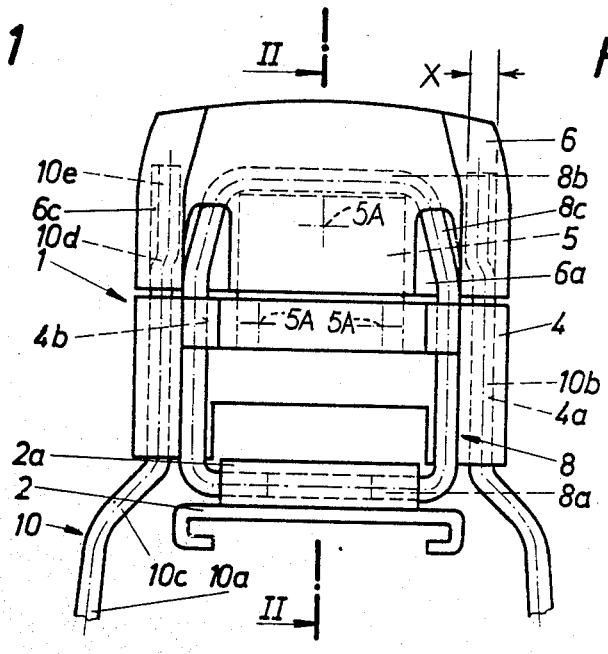
FIG. 1 is a view of the braking mechanism as viewed from the tail of the ski and in the braking position.

The structure of the ski brake according to a first exemplary embodiment, which ski brake forms the subject matter of the present invention, is as follows. The ski brake 1 has a support plate or mounting member 2 with curled over lateral edges which overlap the edges on a guide rail member 7 fixedly secured to the upper surface 11*a* of a ski 11. The ski brake 1 is, by means of a conventional and, therefore, not illustrated coupling mechanism on a ski binding, adjustable along the length of the guide rail member 7 in longitudinal direction of the ski 11 so as to facilitate an adjustment to different size ski boots 9 and together with the ski binding performs all thrust-balancing movements. This type of construction is shown in U.S. Pat. No. 4,210,342, issued July 1, 1980, and reference thereto is to be incorporated herein. A form of construction is also conceivable, in which the support plate 2 is secured in a conventional manner to the upper surface 11*a* of the ski 11 by means of two screws, which are symmetrically arranged with respect to the longitudinal axis of the ski.

In the exemplary embodiment which is illustrated in FIGS. 1 to 4 of the drawings, the support plate 2 has a rectangular shape of uniform thickness. Its length is dimensioned corresponding with the breadth of the guide rail 7 so that the earlier mentioned adjustment in longitudinal direction of the ski 11 is possible. The longitudinal end region at one end of the support plate 2 has on each side a bearing part 2*a* for receiving the ends of an erecting spring 8 therein, which spring will be described in more detail below. The bearing part 2*a* is closed to the front in the direction of an arrow 11*b* which points toward the tip of the ski as well as being closed to the rear, wherein only the end regions of the bearing part 2*a* are open and receive the bent end segments 8*a* (FIG. 15) of the erecting spring 8 therein.

The ski brake 1 has furthermore as important structural parts a support member 4, an operating plate 6, two braking legs 10 and a further spring, which is preferably designed as a leaf spring 5.

Figure 15:
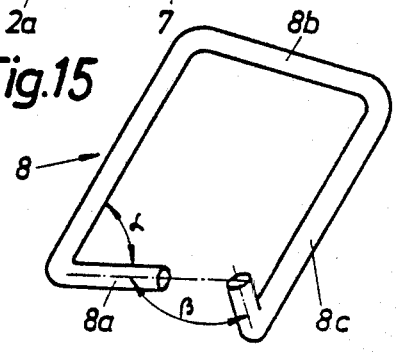
FIG. 15 is a perspective view of the erecting spring.

The erecting spring 8 has in the rear view of FIG. 1 an inverted U-shaped design. In the relaxed position thereof, its two end segments 8*a* define with the plane of the remaining parts of the erecting spring 8 an angle $\alpha$ (FIG. 15). The size of the angle $\alpha$ controls the desired magnitude of the erecting force for the ski brake 1. The larger the angle is, the higher the erecting force or the higher the initial tension becomes in the retracted position. Furthermore, the end segments 8*a* of the erecting spring 8 are positioned in the relaxed position at an angle $\beta$ to one another. The construction of such an erecting spring 8 per se is known (see FIG. 12 of U.S. Pat. No. 3,989,271). The erecting spring 8 is in the region of its end segments 8*a* received in the two bearing parts 2*a* on the support plate 2. Furthermore the erecting spring 8 is guided on the underside of the operating plate 6 and in a manner which will be described in more detail below.

The operating plate 6 is manufactured of a sheet metal and/or of plastic or a different suitable material and has a uniform thickness and a rectangular shape. The laterally spaced regions of the operating plate 6, which regions oppose the two side surfaces of the ski 11, when the braking mechanism is in the retracted position, each have a recess 6*a* therein for receiving the individual legs 8*c* of the erecting spring 8. The two legs 8*c* of the erecting spring 8 are connected through a crossbar segment 8*b*, which is received in a recess 6*b* in the edge of the operating plate 6 facing the support part 4. One end of a leaf spring 5 is secured to the support member 4, and the other end is secured to the operating plate 6 in the recess 6*b*. The leaf spring 5 is, at both ends, riveted to the support member 4 and operating plate 6 as schematically shown at 5A. The leaf spring 5 has in its relaxed position, viewed from the side or in a longitudinal cross-sectional view, a doubly bent form which lends the spring an approximately S-shaped design. The leaf spring 5 urges the plane of the top surface 6A of the operating plate 6 to a position which is offset from the plane of the top surface 4A of the support member 4 (see FIG. 2). For this reason, and since the operating plate 6 is at the same time also biased by the erecting spring 8, it is sufficient if the leaf spring 5 produces a smaller force in relationship to the force of the erecting spring 8. It may, if needed, also be as great as or greater than the force of the erecting spring.

Adjacent each of the recesses 6*a* and each of the lateral edges of the operating plate 6 is an axially extending, when the braking mechanism is in the retracted position, hole 6*c*, the horizontal dimension thereof being larger than the vertical dimension thereof, which vertical dimension is equal to or slightly greater than the diameter of the braking leg wire discussed below. The horizontal dimension is at least equal to or slightly greater than the total lateral width dimension X (FIG. 1) of the wire segments 10*b* and 10*e*. The holes 6*c* each open outwardly of the operating plate 6 in the edge facing the support member 4.

The support member 4 has also a substantially rectangular shape, wherein the two laterally spaced regions of the support member 4 are in alignment with the laterally spaced regions of the operating plate 6. To receive the two legs 8*c* of the erecting spring 8, the support member 4 has on its two lateral sides cylindrical passageways 4*b* extending therethrough.

Figure 3:
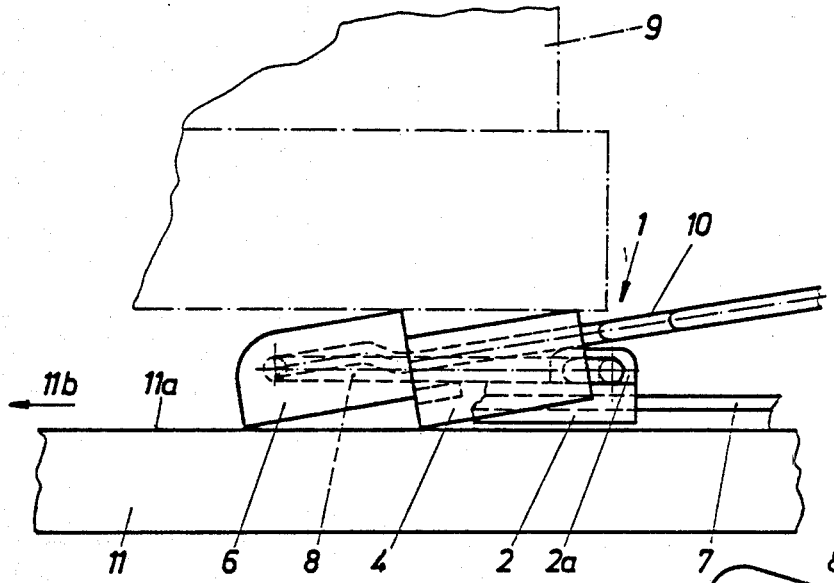
FIG. 3 is a side view of the braking mechanism in an intermediate retracted position.

Each of the two braking legs 10 has a section which functions as a braking mandrel 10*a*. Each braking mandrel 10*a* has in the region of its free end a conventional, here not illustrated, plastic covering. A first bent segment 10*c* follows the braking mandrel 10*a* and extends at an acute angle with respect thereto. An axially extending segment 10*b* follows at another acute angle with respect to the first bent segment 10*c*. The braking leg 10 is with the help of the axially extending segment 10*b* supported for a limited amount of rotation about the axis of the segment 10*b* in the cylindrical bearings 4*a* in the support member 4. The braking mandrel 10*a* and the axially extending segment 10*b* both extend parallel with respect to the longitudinal axis of the ski when the braking mechanism is in the retracted position. A second bent segment 10*d*, which extends in direction toward the central axis of the braking mechanism, follows the segment 10*b* at an angle of approximately 45°, which angle is not identified in any greater detail. Furthermore, the second bent segment 10*d* projects at an angle of approximately 45° from the plane of the leg segments 10*a*, 10*b* and 10*c* in direction away from the ski 11 as shown in FIG. 3. An operating segment 10*e* of the braking leg 10 follows the second bent segment 10*d* and extends parallel to the longitudinal axis of the ski 11 when the braking mechanism is in the retracted position.

Caused by the second bent segment 10*d* which extends in the direction toward the center of the ski, the operating segment 10*e* of each braking leg 10 is received in the recess 6*c* of the operating plate 6.

The ski brake 1 is held in its upright braking position by the erecting spring 8. The erecting spring 8 is thereby in its relaxed condition, or, if desired, initially tensioned position. The operating plate 6 carries along the support member 4 through the connection provided by the braking legs 10 and holds both structural parts in a pivotally supported relation about the bearing part 2*a*. As can be seen from FIGS. 2 and 3, the leaf spring 5 holds the operating plate 6 in the aforesaid offset relationship with respect to the support member 4. The leaf spring 5 is thereby in its relaxed position. Due to the difference in height at which the operating plate 6 is in with respect to the support member 4, and due to the cooperation of the hole 6*c* in the operating plate 6 with the second bent segment 10*d* and the offset operating segment 10*e* of each braking leg 10, the two braking legs 10 are in a position as illustrated in the FIG. 1, namely, the segments 10*a* are positioned on opposite lateral sides of the ski spaced from the lateral edges of the ski. In order to make this position possible, the two recesses 6*c* are required in the operating plate 6 to receive the segments 10*d* and 10*e* of each braking leg 10 therein.

Figure 4:
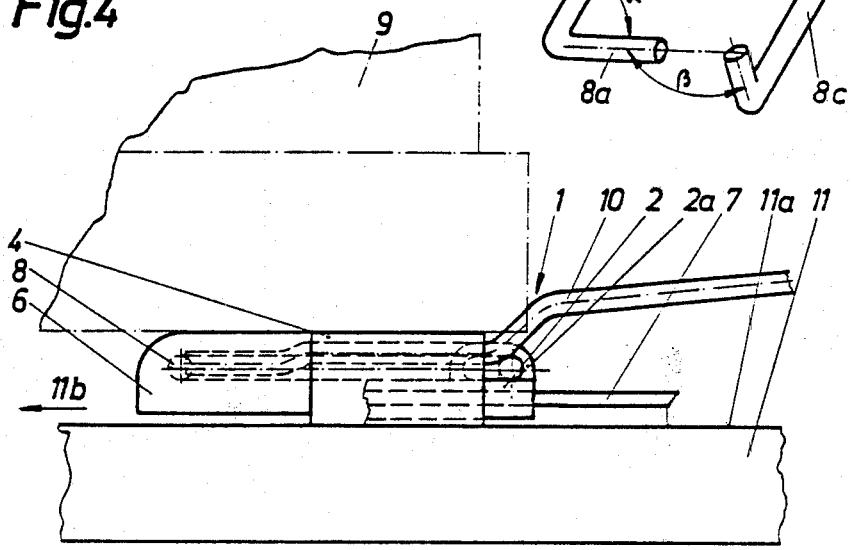
FIG. 4 illustrates the ski brake in the fully retracted position.

If now a force is applied onto the ski brake by the ski boot 9 schematically illustrated in FIGS. 3 and 4, the entire ski brake 1 is pivoted about the ends 8*a* of the spring 8 in the bearing part 2*a*. A relative movement against the force of the leaf spring 5 between the operating plate 6 and the support member 4 does not initially take place. Only after the support member 4 rests on the upper surface 11*a* of the ski 11 and the force from the ski boot 9 continues to be applied onto the operating plate 6, does a relative movement occur between the operating plate 6 and the support member 4 against the urging of the spring 5 with the operating plate moving in approximately a vertical direction toward the ski to thereby tension the leaf spring 5. The braking mandrels 10*a*, which up to now only swing upwardly, are cranked or rotated in above the ski edges each approximately at a 90° angle through said movement. The upper surface of the operating plate 6 is now flush with the upper surface of the support member 4 (compare FIGS. 3 and 4).

Figure 11:
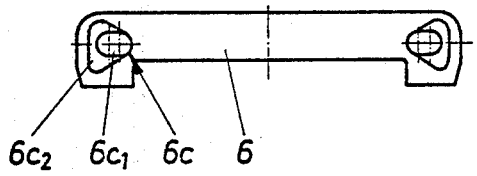
FIG. 11 is an end view of the operating plate showing the opening into which the braking legs extend, however, the braking legs have been omitted.
Figure 12:
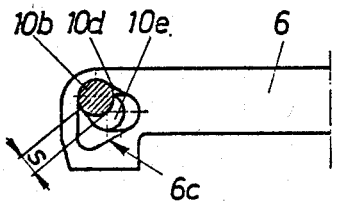
FIGS. 12 to 14 are each an end view of the operating plate showing the opening into which the braking legs extend and the position of the wire segments of the braking legs at various stages in the pivotal movement of the operating plate.
Figure 13:
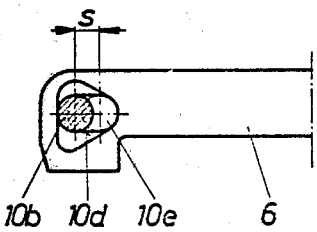
Figure 14:
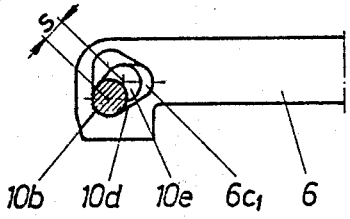

More specifically, FIGS. 11 to 14 illustrate the operating plate 6 each in an end view, wherein the shape of the recesses 6*c* can well be recognized. FIG. 11 illustrates the recesses 6*c* without the braking legs 10 inserted therein, FIG. 12 illustrates the position of the braking legs 10 in the recesses 6*c* in the retracted position of the ski brake, FIG. 13 illustrates a position of the braking legs 10 in the recesses 6*c* during a pivotal movement of the braking mechanism from the retracted position into the braking position or vice versa and FIG. 14 illustrates the position of the braking legs 10 in the recesses 6*c* in the braking position of the ski brake.

Each recess 6*c* has two areas $6c_1$, $6c_2$, wherein one region thereof is constructed as a slotted hole $6c_1$ and in which the operating part 10*e* of the braking leg 10 is supported, the length of which corresponds with the length of the operating part 10*e* and the width of which, viewed in a plane parallel to the upper surface of the operating plate 6, corresponds approximately to one and one-half times the diameter of the operating part 10*e*. The recess 6*c* has a triangular enlargement $6c_2$ in its region which faces the support member (not illustrated). The length of the enlargement $6c_2$ corresponds approximately with the length of the projection of the segment 10*d* of the braking leg 10 on the upper side of the operating plate 6.

In the retracted position of the ski brake, the operating part 10*e* of each braking leg 10 is arranged in the region of the slotted hole $6c_1$, which region is adjacent to the laterally outer surface of the operating plate 6. The segment 10*d* of each braking leg 10 is arranged in the enlargements $6c_2$ of each recess 6*c* so that it projects from the operating part 10*e* into the upper region of the enlargement $6c_2$. The axial part 10*e* which extends in the support member 4 follows the section 10*d*.

During a swinging of the braking mechanism from the retracted position, in which position the braking mandrels 10*a* are in a position above the upper surface 11*a* of the ski, into the braking position, first the leaf spring 5 assumes its relaxed position, the operating plate 6 is urged away from the support member 4. During this sequence of operation the braking legs 10 are rotated through a 90° angle. FIG. 13 illustrates the position of operating part 10*e*, segment 10*d* and the axial part 10*b* after a rotation of approximately 45°, whereby in this position the operating part 10*e* is moved in the slotted hole $6c_1$ toward the center of the operating plate 6. In the braking position of the ski brake (FIG. 14), the operating part 10*e* of each braking leg 10 is again arranged in the region of the slotted hole $6c_1$, which region is adjacent to the lateral outer surface of the operating plate 6, the segment 10*d* projects into the lower corner region of the enlargement $6c_2$.

When the force which is produced by the ski boot 9 or a ski boot having a sole plate secured thereto terminates, both the leaf spring 5 and the erecting spring 8 try to attain their relaxed position illustrated in FIG. 1. The leaf spring 5, which only has to overcome the mass inertia of the operating plate 6 and of the two braking legs 10, quickly and faster than the spring 8, assumes its relaxed position. Thus for the present only the two braking mandrels 10*a* are swung out beyond the lateral edges of the ski. Only thereafter does the erecting spring 8 which engages the operating plate 6 swing the entire ski brake 1, through the connection provided by the braking legs 10, about the axis of the bearing part 2*a*. In this manner, an undesired snagging of the braking mandrels 10*a* on each braking leg 10 or of the braking blades (not illustrated) arranged on the individual braking mandrels 10*a* on the edges of the ski is prevented.

Figure 2:
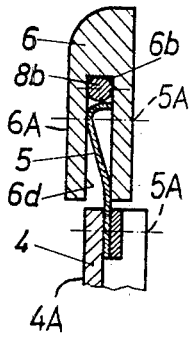
FIG. 2 is a cross-sectional view taken along the line II—II of FIG. 1.

As is readily apparent from FIG. 2, the leaf spring 5 serves at the same time as a bearing part for the crossbar segment 8*b* of the erecting spring 8 in the operating plate 6, wherein the region of the leaf spring 5 adjacent the operating plate 6, is received in the recess 6*b* in the operating plate 6 and is bent on its end facing the crossbar segment 8*b* of the erecting spring 8.

Figure 5:
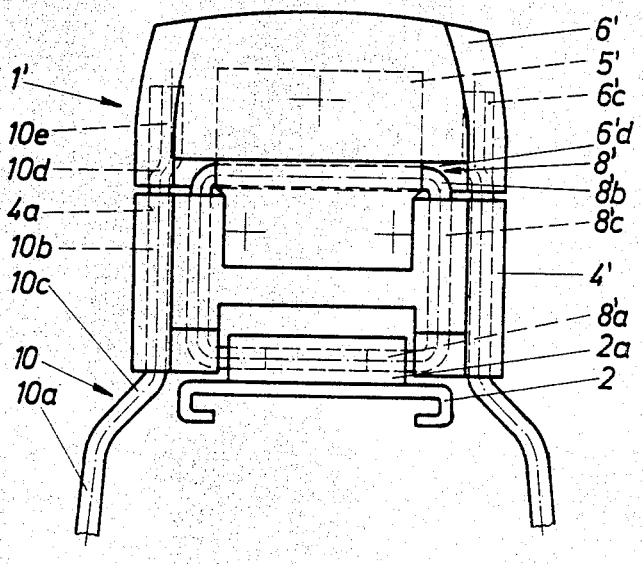
FIG. 5 illustrates a view of a second exemplary embodiment similar to FIG. 1 and as viewed from the tail of the ski.
Figure 6:
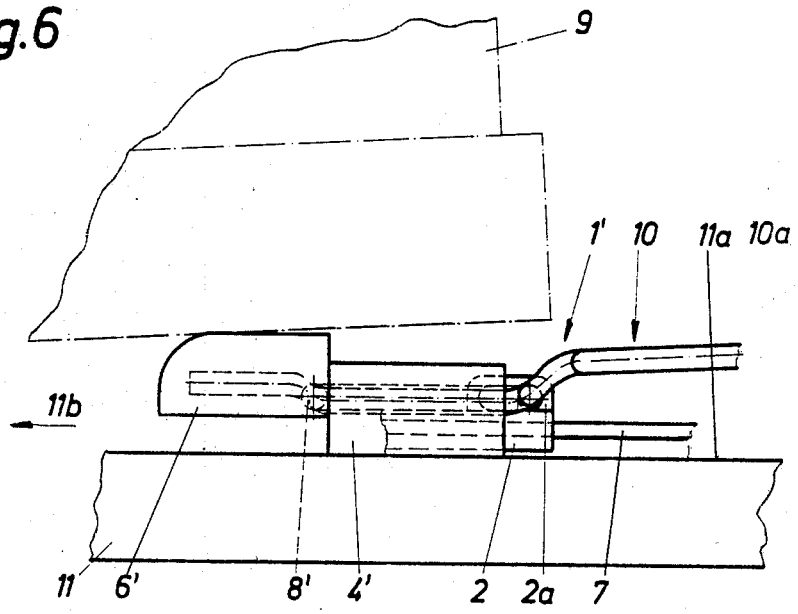
FIG. 6 illustrates a side view of the braking mechanism of FIG. 5 in an intermediate retracted position.

As will be apparent from the exemplary embodiment according to FIGS. 5 and 6, the erecting spring 8′ is only associated with the support member 4′, that is, the crossbar segment 8′*b* of the erecting spring 8′ extends in a recess or notch 6′*d* in the edge of the operating plate 6′ facing the support plate and engages the leaf spring 5′ on its side which faces the upper surface 11*a* of the ski 11 when the braking mechanism is in the retracted position. In this embodiment of the ski brake 1′, as is apparent from FIG. 6, the relative movement from the stepped-down partially retracted condition of the operating plate 6′ into the fully retracted position of the ski brake 1′ is greater than in the first exemplary embodiment, because the operating plate 6′ experiences during its movement from the partially retracted position into the fully retracted position a movement of its upper surface while remaining parallel to the upper surface of the ski. In this manner, the pivoting of the individual braking legs 10 or their braking mandrels 10*a* is still more effective than in the case of the first exemplary embodiment.

Figure 7:
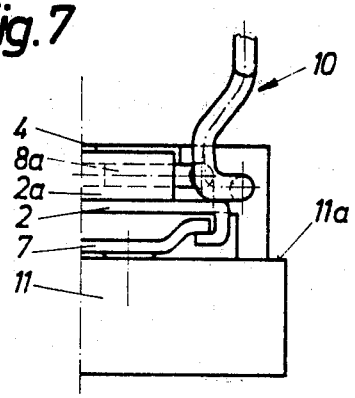
FIGS. 7,8 and FIGS. 9,10 illustrate end views of two different embodiments of the braking legs for the ski brake.
Figure 8:
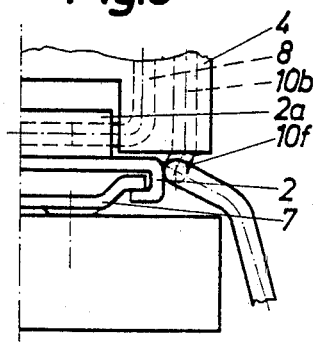
Figure 9:
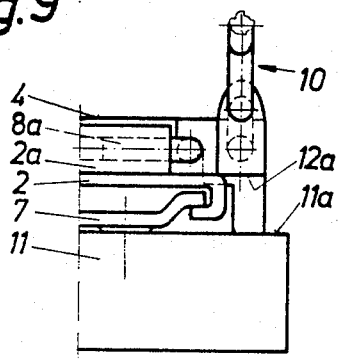
Figure 10:
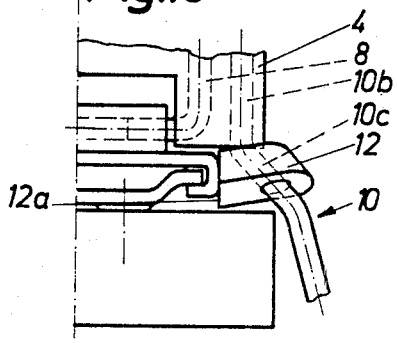

FIGS. 7 and 8, on the one hand, and FIGS. 9 and 10 on the other hand, each illustrate, respectively, a front end view of an exemplary embodiment in the fully retracted position and in the braking position of the ski brake, wherein in each case only one-half thereof and a fragment of the braking legs has been illustrated. Particularly in these figures, the guide rail 7 which is secured to the upper surface 11*a* of the ski with only the schematically indicated screws is readily apparent, on which guide rail the support plate 2, also in a conventional manner, can be adjusted in the longitudinal direction of the ski 11. The support plate 2 can be locked in a conventional manner relative to the guide rail 7; this part is not the subject matter of the invention but is known from U.S. Pat. No. 4,022,493. The bearing part 2*a* is provided on the support plate 2, in which bearing part the free ends 8*a* of the erecting spring 8 are anchored or supported. Furthermore the support member 4 rotatably supports the axially extending segments 10*b* of the individual braking legs 10. Up to this point, the embodiment of FIGS. 7 and 8 on the one hand and of FIGS. 9 and 10 on the other hand are the same.

In the further embodiment according to FIGS. 7 and 8, each braking leg 10 has a collar which is constructed in the form of a bent segment 10*f*, which is supported on the support plate 2 and rolls along during a rotation of each braking leg 10 from the braking position into the fully retracted position and vice versa. Particularly advantageous is the movement from the fully retracted position into the braking position because through this construction each braking leg 10 encounters a kind of a rigid guide so that upon the action of the erecting spring 8, as was already described above, not only the braking mechanism itself is pivoted, but also the two braking legs are rotated. This will occur even when masses of snow should act against this movement.

In the embodiment according to FIGS. 9 and 10, a separate collar 12 is secured on the first bent segment 10*c* of each braking leg 10, which collar has a flattened portion 12*a* on the region thereof which faces the support plate 2. This assures a particularly exact guiding or controlling of the movement of the braking leg. The collar 12 is in the present exemplary embodiment constructed as a structural part which is independent of the material of the braking leg 10. The material for the collar 12 is here a plastic. This has the advantage that the ski brake can easily be adjusted to different width support plates 2. However, it is also possible to make the collar 12 of the material of the braking leg 10 or of a different metal than the one of which the braking leg 10 consists.

The invention is not to be limited to the illustrated exemplary embodiments. Further modifications are conceivable without departing from the scope of the invention. For example, it is possible to use a different ski binding part than the support plate to support the collar or the bent segments of the individual braking legs, which bent segments are constructed as collars. Also this development and the form of the collar or of the individual bent segments can be changed as desired, the condition being that a rigid control is assured. Also the form of the bearing part and its construction may be different than described. Also it is possible to use a separate part and to secure same on the support plate. It depends on the type of manufacture which embodiment is chosen. Also the designer has a free choice with respect to the determination of the material for the support member and for the operating plate. The two structural parts can be manufactured of a plastic material, wherein particularly areas which are exposed to high stresses can consist of a wear-resistant material or can be provided with inserts of such a material. It is also conceivable to provide those areas which experience friction with a covering of a low friction material or to design them all together of such a material.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a ski brake having at least one braking leg pivotal by a force applied by a ski boot or by a sole plate secured to a ski boot to a pedal about an axle extending substantially at a right angle with respect to the longitudinal axis of a ski in a mounting member adapted to be secured to said ski, said braking leg being pivotal between a braking position and a retracted position, an erecting spring resisting a pivoting of said braking leg toward said retracted position, said braking leg having a braking mandrel thereon and a first segment therein which extends from said braking mandrel toward the central longitudinal axis of the ski, said braking leg being held totally above the upper surface of said ski and between the lateral edges of said ski in the retracted position of said ski brake by said pedal which is stepped down upon by said ski boot or by said sole plate, and in the braking position of said ski brake, said braking mandrel being positioned laterally outside of one of said ski edges and projecting below the running surface of said ski, said braking leg being pivotal about first means defining a swivel shaft which extends in longitudinal direction of said ski, said first means including at least one further second segment on said braking leg which extends substantially parallel with respect to said central longitudinal axis of said ski brake when said braking leg is in said retracted position, and second means operatively connecting said second segment to said axle to facilitate said pivotal movement of said braking leg about the axis of said second segment, the improvement comprising wherein third means are provided on said braking leg intermediate said braking mandrel and said second segment for engaging a lateral edge of said mounting member and guiding the movement of said braking leg between said braking position and said retracted position.

2. The ski brake according to claim 1, wherein said mounting member is movable on a guide rail in the longitudinal direction of the ski.

3. The ski brake according to claim 1 or 2, wherein said third means is constructed of the material of said braking leg and is in the form of a bent segment.

4. The ski brake according to claim 1 or 2, wherein said third means is a plastic collar member encasing said first segment.

5. The ski brake according to claim 4, wherein said mounting member has a curved lateral edge surface, and wherein said third means, which faces said curved lateral edge portion of said mounting member, has a flattened portion.

6. The ski brake according to claim 1, wherein said mounting member has a curved lateral edge surface, and wherein said third means has a camlike curvature which engages said curved lateral edge surface.

7. In a ski brake having at least one braking leg pivotal by a force applied by a ski boot or by a sole plate secured to a ski boot to a pedal about an axle extending substantially at a right angle with respect to the longitudinal axis of a ski in a mounting member adapted to be secured to said ski, said braking leg being pivotal between a braking position and a retracted position, an erecting spring resisting a pivoting of said braking leg toward said retracted position, said braking leg having a braking mandrel thereon and a first segment therein which extends from said braking mandrel toward the central longitudinal axis of the ski, said braking leg being held totally above the upper surface of said ski and between the lateral edges of said ski in the retracted position of said ski brake by said pedal which is stepped down upon by said ski boot or by said sole plate, and in the braking position of said ski brake, said braking mandrel being positioned laterally outside of one of said ski edges and projecting below the running surface of said ski, said braking leg being pivotal about first means defining a swivel shaft which extends in longitudinal direction of said ski, said first means including at least one further second segment on said braking leg which extends substantially parallel with respect to said central longitudinal axis of said ski brake when said braking leg is in said retracted position, and second means operatively connecting said second segment to said axle to facilitate said pivotal movement of said braking leg about the axis of said second segment, said pedal includes a support member pivotally secured to said mounting member by said axle for movement about said axle, wherein said second means includes bearing means on said support member and having an axis extending generally parallel to said longitudinal axis of said ski when said ski brake is in said retracted position, said second segment being rotatably received in said bearing means, said second means further including laterally offset means on said second segment and extending laterally of said axis, said second means still further including an operating plate operatively connected to said laterally offset means and supported for movement relative to said support member between first and second positions, said first position being elevated above said support member and said second position being flush with said support member, said operating plate effecting a movement of said braking leg to said retracted position in response to a movement of said operating plate from said first position toward said second position thereof, wherein resilient means is provided separate from said erecting spring for continually urging said operating plate to said first position, said erecting spring being generally U-shaped having a pair of parallel legs and a bight portion, the two free ends of which being bent inwardly and out of a plane defined by said parallel legs, said mounting member having a recess receiving said free ends therein to orient said legs in a position inclined to the horizontal, the improvement comprising wherein said support member includes third means engaging and holding said legs of said erecting spring so that said support member remains fixedly oriented to said legs of said erecting spring, fourth means on said support member for limiting the movement of said support member and, consequently, said legs of said erecting spring to a partially retracted position of said braking mandrel intermediate said braking position and said retracted position, said resilient means providing the only additional force to overcome in order to effect a movement of said operating plate from said partially retracted position to said second position thereof.

8. The ski brake according to claim 7, wherein said bight portion of said U-shaped erecting spring is received in a recess on the edge of said operating plate adjacent said support member.

9. The ski brake according to claim 8, wherein said bight portion of said erecting spring grips under said resilient means, which resilient means is constructed as a leaf spring, and wherein said leaf spring is secured on the underside of both said support member and said operating plate by fastening means to thereby hold said operating plate at a distance relative to said support member.

10. The ski brake according to claim 7, wherein said operating plate is connected to said support member through said resilient means which is constructed as a leaf spring, a portion of said leaf spring being oriented in a recess in said operating plate and has a bent portion receiving said bight portion of said erecting spring therein.

11. The ski brake according to claim 7, wherein said braking leg has an operating part extending in a recess provided in said operating plate, which recess has a lateral dimension greater than a dimension in the vertical direction, the dimension in said vertical direction being equal to or slightly greater than the dimension of said operating part of said braking leg.

* * * * *